US009470187B2

(12) United States Patent
Gliwa et al.

(10) Patent No.: US 9,470,187 B2
(45) Date of Patent: Oct. 18, 2016

(54) EGR HEAT EXCHANGER WITH CONTINUOUS DEAERATION

(71) Applicants: James Gliwa, Orion, MI (US); Gary M Pallach, Chesterfield, MI (US)

(72) Inventors: James Gliwa, Orion, MI (US); Gary M Pallach, Chesterfield, MI (US)

(73) Assignee: FCA US LLC, Auburn Hills, MI (US)

( * ) Notice: Subject to any disclaimer, the term of this patent is extended or adjusted under 35 U.S.C. 154(b) by 186 days.

(21) Appl. No.: 14/252,030

(22) Filed: Apr. 14, 2014

(65) Prior Publication Data

US 2015/0292444 A1 Oct. 15, 2015

(51) Int. Cl.
*F02M 25/07* (2006.01)
*F01P 9/00* (2006.01)
*F28F 1/10* (2006.01)

(52) U.S. Cl.
CPC ..... *F02M 26/28* (2016.02); *F02M 26/32* (2016.02); *F02M 26/33* (2016.02)

(58) Field of Classification Search
CPC ..... F02M 25/0731; F02M 25/0738; F02M 25/0737
USPC ..... 123/568.12, 41.01; 60/41, 67
See application file for complete search history.

(56) References Cited

U.S. PATENT DOCUMENTS 7,461,641 B1 12/2008 Styles
8,230,843 B2 7/2012 Kurtz
8,375,926 B2 2/2013 Sheidler
8,429,895 B2 4/2013 Kawazu
2006/0130818 A1* 6/2006 Igami ..... F02M 25/0737 123/568.12
2008/0223024 A1* 9/2008 Kammler ..... F01N 5/02 60/320
2010/0084111 A1* 4/2010 Jaeger ..... B63H 21/383 165/41
2011/0308778 A1* 12/2011 Tsuda ..... F02M 25/0737 165/157

FOREIGN PATENT DOCUMENTS

JP 2003336548 * 11/2003

* cited by examiner

*Primary Examiner* — Lindsay Low
*Assistant Examiner* — Syed O Hasan
(74) *Attorney, Agent, or Firm* — Ralph E. Smith

(57) ABSTRACT

An exhaust gas recirculation (EGR) heat exchange unit having an integrated heat exchange chamber and an integrated deaeration chamber is provided. A coolant opening and a deaeration opening each form direct passageways from the heat exchange chamber to the deaeration chamber. The heat exchange unit is configured to cool exhaust gas flowing through an exhaust gas transfer passage with coolant flowing within the heat exchange chamber and around the transfer passage. The heat exchange unit is configured to be mounted relative to an engine at an incline such that the deaeration opening is configured to evacuate gas from the heat exchange chamber to the deaeration chamber and the flow of coolant into the deaeration chamber through the coolant opening is configured to route the evacuated gas out of the deaeration chamber via the coolant outlet.

11 Claims, 5 Drawing Sheets

EGR HEAT EXCHANGER WITH CONTINUOUS DEAERATION

FIELD

The present disclosure relates generally to an exhaust gas recirculation system for a vehicle and, more particularly, to an exhaust gas recirculation system having a heat exchanger with a deaeration arrangement.

BACKGROUND

Automotive vehicles may utilize an exhaust gas recirculation (EGR) system to recirculate a portion of the exhaust gas to the combustion chambers of the cylinder head for nitrogen oxides (NOx) emission control. The EGR system may include an EGR cooler upstream of the intake manifold and configured to cool the recirculated exhaust gas to improve the charge efficiency of the exhaust gas into the combustion chamber. This, in turn, reduces the temperature of combustion in the cylinder head combustion chamber in an effort to more efficiently suppress the generation of NOx. Such EGR cooler arrangements may trap air in the cooler during a service fill or vapor as a result of coolant boiling within the EGR cooler. Either of these scenarios may lead to undesirable overheat conditions in the EGR cooler, including potential mechanical failure of the cooler components. Thus, while conventional EGR coolers work for their intended purpose, there remains a need for improvement in the relevant art.

SUMMARY

In one aspect, a heat exchanger for an exhaust gas recirculation system for an engine is provided in accordance with the teachings of the present disclosure. In one exemplary implementation, the heat exchanger includes an exhaust gas recirculation (EGR) heat exchange unit having an integrated heat exchange chamber and deaeration chamber. The heat exchange chamber includes a coolant inlet, a coolant opening, an exhaust gas inlet, an exhaust gas outlet, a transfer passage within the heat exchange chamber coupling the exhaust gas inlet to the exhaust gas outlet, and a deaeration opening. The deaeration chamber includes a coolant outlet. The coolant opening and the deaeration opening each form direct passageways from the heat exchange chamber to the deaeration chamber. The heat exchange unit is configured to cool exhaust gas flowing through the transfer passage with coolant flowing within the heat exchange chamber and around the transfer passage. The heat exchange unit is adapted to be mounted relative to the engine at an incline such that the deaeration opening is configured to evacuate gas from the heat exchange chamber to the deaeration chamber and the flow of coolant into the deaeration chamber through the coolant opening is configured to route the evacuated gas out of the deaeration chamber via the coolant outlet.

In another aspect, a vehicle is provided in accordance with the teachings of the present disclosure. In one exemplary implementation, the vehicle includes an engine system having an exhaust gas recirculation (EGR) system and a heat exchanger for the EGR system. The engine system includes an engine having an intake manifold and an exhaust manifold, and a cooling circuit. The EGR system is fluidly coupled to the intake manifold and the exhaust manifold, and the cooling circuit is fluidly coupled to the engine and the EGR system. The heat exchanger includes a housing forming a heat exchange chamber and a separate deaeration chamber in fluid communication with the heat exchange chamber. The heat exchange chamber includes a coolant inlet, a coolant opening, an exhaust gas inlet, an exhaust gas outlet, a transfer passage in the heat exchange chamber coupling the exhaust gas inlet and outlet, and a deaeration opening. The deaeration chamber includes a coolant outlet. The coolant opening and the deaeration opening each form direct passageways from the heat exchange chamber to the deaeration chamber. The heat exchange unit is configured to cool exhaust gas from the exhaust manifold flowing through the transfer passage with coolant from the cooling circuit flowing into the heat exchange chamber via the coolant inlet and around the transfer passage. The heat exchanger is configured to be mounted relative to the engine at an incline such that the deaeration opening is configured to evacuate gas from the heat exchange chamber to the deaeration chamber and the flow of coolant into the deaeration chamber through the coolant opening is configured to route the evacuated gas out of the deaeration chamber via the coolant outlet to the cooling circuit.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

Figure 1:
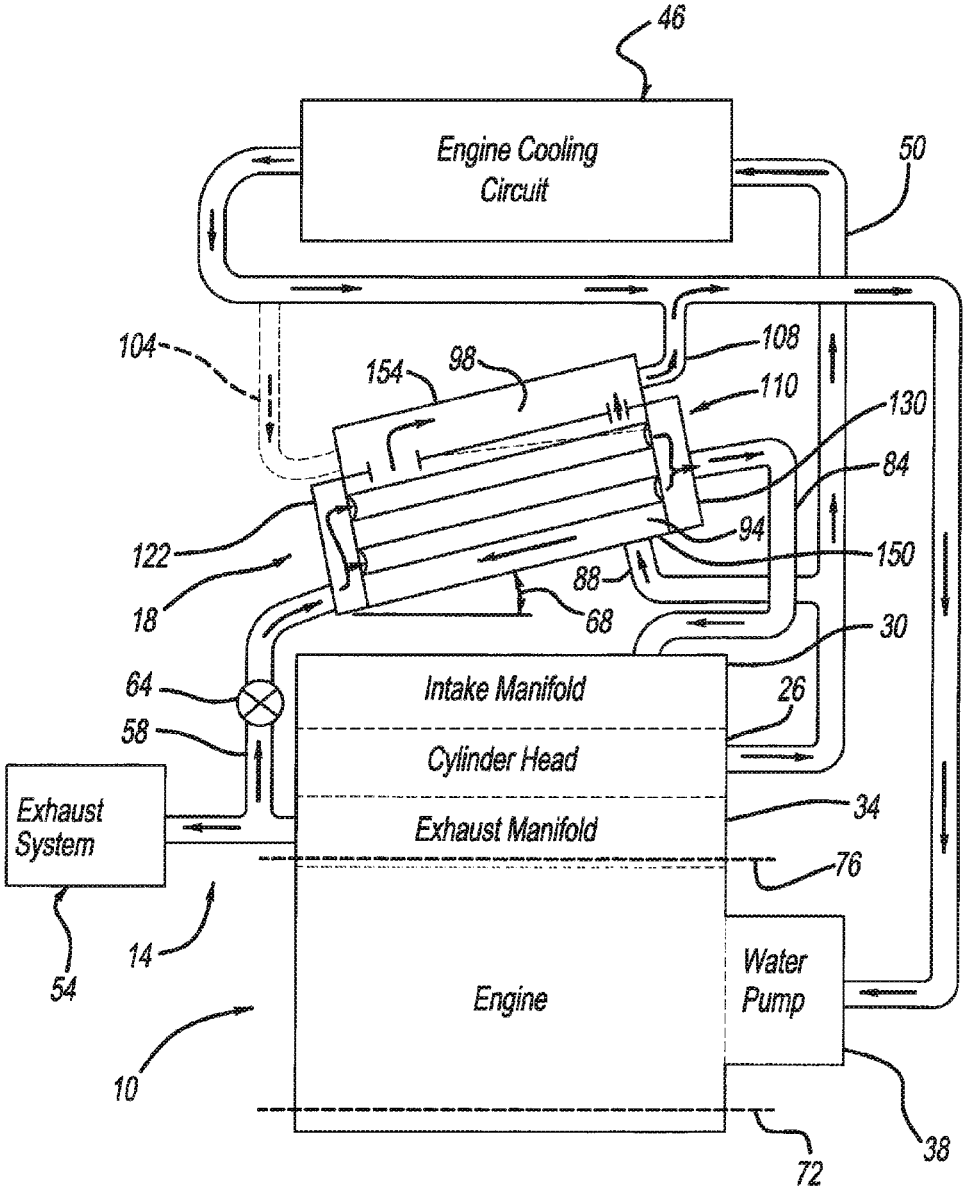
FIG. 1 is a partial schematic view of an exemplary engine system including an exemplary exhaust gas recirculation (EGR) system having an exemplary EGR heat exchanger with continuous deaeration according to the principles of the present disclosure.

With initial reference to FIG. 1, an exemplary engine or engine system is schematically shown and generally identified at reference numeral 10. In the exemplary implementation illustrated, the engine system 10 includes an exemplary exhaust gas recirculation system 14 having an exemplary exhaust gas heat exchanger 18 with continuous deaeration. As will be discussed in greater detail below, the exhaust gas heat exchanger 18, in one exemplary implementation, includes a heat exchange chamber configured to transfer heat from exhaust gas passing therethrough and an integrated deaeration chamber in direct fluid communication with the heat exchanger chamber. The deaeration chamber is configured to provide for continuous deaeration of the heat exchanger chamber thereby reducing the potential for overheating in the heat exchanger chamber, which reduces efficiency and durability of the exhaust gas heat exchanger 18.

In one exemplary implementation, the exhaust gas heat exchanger 18 provides an integrated deaeration arrangement for a counter-flow EGR heat exchanger where the heat exchanger 18 is mounted at an incline relative to an exhaust manifold of an associated engine. As will be discussed in greater detail below, the integrated deaeration arrangement provides for deaeration of the heat exchanger chamber when the coolant outlet is required to be on the low side of the inclined EGR heat exchanger so as to provide for adequate drainage of exhaust gas condensation while also providing a counter-flow cooling arrangement.

As will also be discussed in greater detail below, various aspects of the integrated deaeration chamber further provide for a reduction in cooling circuit connections, thereby reducing potential leak points in the cooling circuit. In one exemplary implementation, the deaeration chamber incorporates by-pass flow from the engine cooling circuit, thereby further reducing cooling circuit connections and aiding in the evacuation of gas/air from the deaeration chamber.

With continuing reference to FIG. 1, a general discussion of the exhaust gas heat exchanger 18 and supporting engine and cooling system components will now be discussed. Example implementations of heat exchanger 18 according to various aspects of the present disclosure will then follow in greater detail with particular reference to FIGS. 2-5.

The exemplary engine 10 includes a cylinder head 26, an intake manifold 30, an exhaust manifold 34 and a water pump 38. While the discussion will continue with reference to engine 10 and the associated components, it will be appreciated that engine 10 may include various other components not specifically discussed or shown. It will also be appreciated that engine 10 may be of various internal combustion engine types, including a gasoline burning engine, a diesel burning engine and an alternative fuel burning engine, such as bio-diesel and ethanol, or combinations thereof.

In the exemplary implementation illustrated, the water pump 38 is fluidly coupled to and pumps coolant into the engine 10, its cylinder head 26 and to an engine cooling circuit 46 via an engine coolant outlet line 50. The exhaust manifold 34 is fluidly coupled to an exhaust system 54 and the exhaust gas heat exchanger 18 via an exhaust gas inlet line 58. In one exemplary implementation, the exhaust gas inlet line 58 includes an EGR valve 64 for controlling an amount of exhaust gas that is recirculated to the intake manifold 30.

As can be seen in FIG. 1, the exhaust gas heat exchanger 18 is angled (e.g., angle 68) relative to the engine 10. In the particular example illustrated, the heat exchanger 18 is angled relative to a longitudinal axis 72 of the engine 10 and/or a longitudinal axis 76 of the exhaust manifold 34. Mounting or assembling the exhaust gas heat exchanger 18 relative to the engine 10 in the angled manner shown, provides for draining any exhaust gas moisture and/or condensation resulting from operation of heat exchanger 18. More specifically, any moisture or condensation in the internal exhaust gas transfer passages (discussed below) of heat exchanger 18 will drain back to the exhaust manifold 34 via line 58 as a result of the angled nature of heat exchanger 18.

Exhaust gas heat exchanger 18 receives exhaust gas from line 58 and, once the exhaust gas flows through heat exchanger 18, it exits the heat exchanger and is routed to the intake manifold 30 via a line or connection 84. It will be appreciated that while exhaust gas heat exchanger 18 is shown in connection with a naturally aspirated engine 10, exhaust gas heat exchanger 18 may also be utilized with a boosted engine, such as with a turbo charger or a super charger.

The exhaust gas heat exchanger 18 also receives coolant from cooling circuit 46 via a coolant line 88. A coolant inlet to the heat exchanger 18 is positioned on an opposite or substantially opposite side or area as the exhaust gas inlet so as to provide flow of coolant in an opposite or substantially opposite direction as the flow of exhaust gas through heat exchanger 18. This provides for a counter-flow heat exchanger arrangement, which enhances the heat transfer between the exhaust gas and the coolant.

Once the coolant enters the heat exchanger 18, the coolant flows in a heat exchange chamber 94 in a generally opposite direction as the exhaust gas while surrounding the one or more exhaust gas transfer passages carrying exhaust gas through the heat exchanger 18. When hot exhaust gas from the exhaust manifold 34 flows through the heat exchanger, the coolant cools the exhaust gas by transferring heat from the exhaust gas to the coolant. The coolant exits through a primary coolant opening into a deaeration chamber 98 integrated into or with the exhaust gas heat exchanger 18. An optional coolant return line 104, such as a heater core return line, can be plumbed or fluidly coupled to the deaeration chamber 98 to reduce coolant circuit connections and aid in the evacuation of gas or air therefrom, as will be discussed in greater detail below. The deaeration chamber 98 includes a coolant exit returning coolant to the cooling circuit 46 via a coolant line 108. A deaeration opening is provided between the heat exchange chamber 94 and the deaeration chamber 98 to provide deaeration of the inclined counter-flow heat exchanger 18, as will be discussed in greater detail below in connection with the example implementations shown in FIGS. 2-5.

Figure 2:
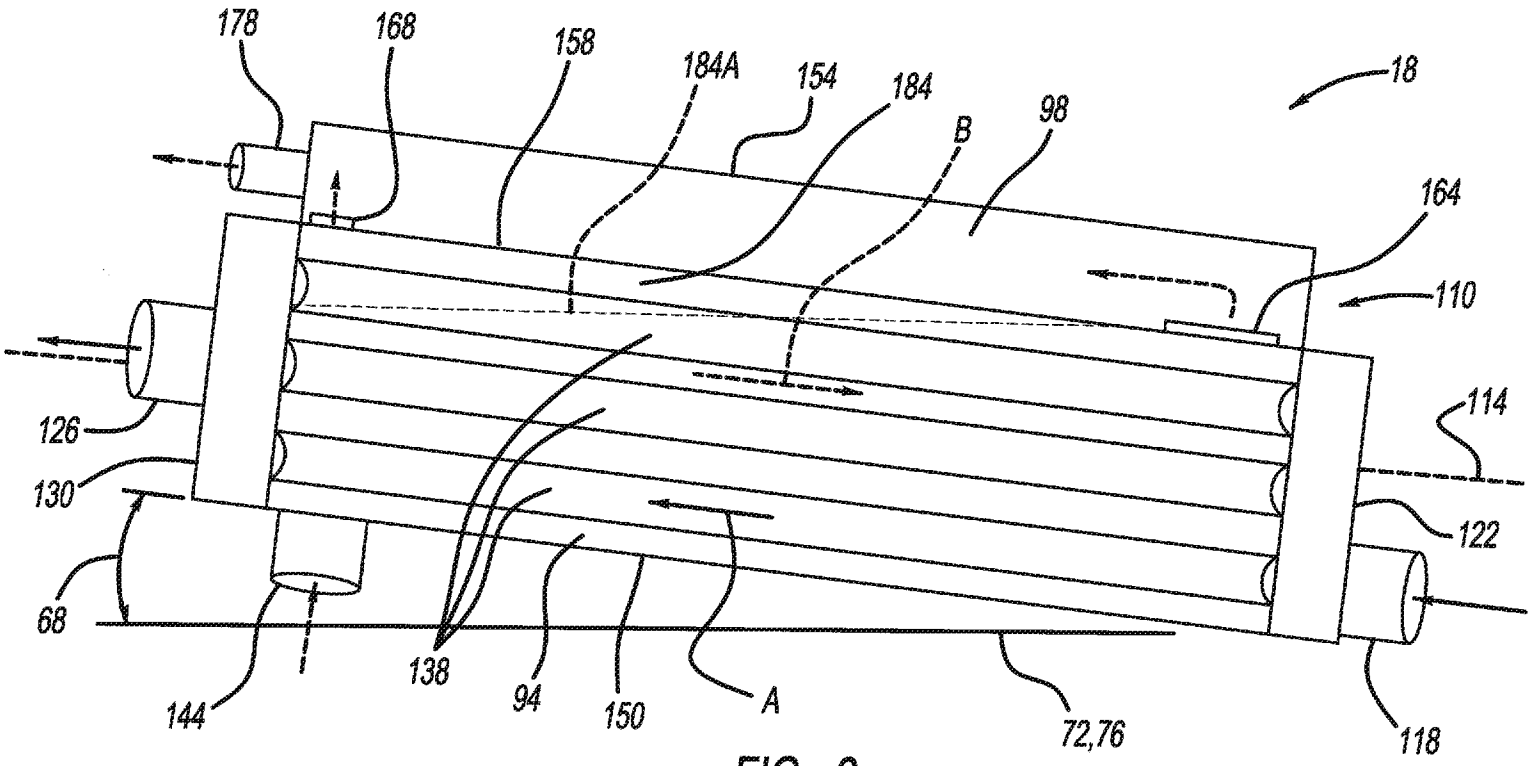
FIG. 2 is a schematic illustration of an exemplary implementation of the EGR heat exchanger with continuous deaeration according to the principles of the present disclosure.

With particular reference to FIG. 2 and continuing reference to FIG. 1, one example implementation of exhaust gas heat exchanger 18 is shown and will now be discussed. In this example implementation, heat exchanger 18 includes an outer shell or housing 110 that contains or houses the heat exchange chamber 94 and the deaeration chamber 98. In one exemplary configuration, the housing 110 forms the heat exchange and deaeration chambers 94, 98. The housing 110 includes an elongated shape or configuration having a longitudinal axis 114. The housing 110 includes or defines an exhaust gas inlet 118 on a first or lower exhaust gas inlet end 122 and an exhaust gas outlet 126 on an opposed second or upper exhaust gas outlet end 130.

One or more exhaust gas transfer passages 138 extend through the heat exchange chamber 94 from the exhaust gas inlet 118 to the exhaust gas outlet 126. Exhaust gas flows through the heat exchange chamber 94 from the inlet 118 to the outlet 126 via the transfer passages(s) 138 in the general direction of arrow A. The transfer passages 138 may take various forms or configurations and are configured to carry the exhaust gas through the heat exchange camber 94 while separating the exhaust gas from the coolant flowing therein.

The housing 110 includes or defines a coolant inlet 144 at or proximate the upper end 130 for receiving coolant from the coolant circuit 46. In the exemplary implementation illustrated, the coolant inlet 144 is positioned substantially at the upper end 130 at a bottom side 150 of the housing 110 opposite an upper side 154. The exhaust gas heat exchanger 18 includes an internal chamber wall or member 158 that defines an upper side of the heat exchange chamber 94 and a lower side of the deaeration chamber 98. In other words, in one exemplary implementation, the chamber wall 158 separates or partitions an overall chamber or internal volume formed by housing 110 into the heat exchange chamber 94 and the deaeration chamber 98. It will be appreciated that the chamber wall 158 may also be formed by separate members of the heat exchange chamber 94 and the deaeration chamber 98 coupled together.

A primary coolant opening or passage 164 is provided in or defined by the chamber wall 158 at or proximate the lower end 122. As can be seen in FIG. 2, the coolant opening 164 and the coolant inlet 144 are positioned at or substantially at opposite ends 122, 130 of the heat exchanger 18. A deaeration opening 168 is provided in or defined by chamber wall 158 at or substantially at the upper end 130. It will be appreciated that openings 164, 168 can be formed directly in or by the wall member 158 and/or can be fittings or valves, such as a one-way valve, positioned in chamber wall 158 at the locations discussed above.

The deaeration opening 168 includes a smaller width or area than the primary coolant opening 164 so as to direct a majority of the coolant flow from the coolant inlet 144 at the upper end 130 to the primary opening 164 at the lower end 122 thereby providing counter-flow of the coolant relative to the exhaust gas. For example and as generally discussed above, exhaust gas flows generally in the direction of arrow A and coolant flows generally in the direction of arrow B. The deaeration opening 168 is configured to provide an outlet or air bleed from the heat exchange chamber 94 for any air or gas therein to flow into the deaeration chamber 98 in the counter-flow arrangement where the exhaust gas heat exchanger 18 is angled in the manner discussed above and shown in the figures. The deaeration chamber 98 includes or defines a coolant outlet 178 for coolant and evacuated air or gas in the deaeration chamber 98 to exit the deaeration chamber 98 to the coolant circuit 46.

In operation, exhaust gas enters the counter-flow heat exchanger 18 via the exhaust gas inlet 118 and flows through the transfer passage(s) 138 toward and through the exhaust gas outlet end 130 in the general direction of arrow A. Coolant enters the heat exchanger 18 and initially flows into the heat exchange chamber 94 where the coolant fills the heat exchange chamber 94 flowingly surrounding transfer passage(s) 138 to cool the exhaust gas flowing therein.

During coolant service fills and/or operation of the heat exchanger 18, air/gas may accumulate in the area identified by reference number 184 and the exemplary broken line 184A (when deaeration opening 168 is not utilized), which is at a higher point or area than the coolant opening 164. For example, in certain operating conditions, a portion of the coolant flowing in the heat exchange chamber 94 may boil or be vaporized by the hot exhaust gas flowing through the transfer passage(s) 138. Without the deaeration opening 168, the air or gas may be trapped in area 184, which would reduce the performance of the heat exchanger 18. The trapped gas/air would reduce heat transfer in this area of the heat exchanger causing higher temperatures, which would potentially reduce the durability and/or life span of the heat exchanger 18.

As previously discussed, for the counter-flow heat exchanger 18, it may be advantageous to mount or orientate the heat exchanger as shown in the various figures so that any condensation in the heat exchanger 18 exhaust gas flow path may drain back into the exhaust manifold 34, where it will evaporate and/or be vaporized. In this exemplary angled implementation of the counter-flow heat exchanger 18, the coolant outlet from the heat exchange chamber 94 is positioned at the first or lower end 122, as also shown in the various figures of the present disclosure. As a result, without deaeration opening 168, gas/air from heat exchanger 18 operation and/or a service fill will become trapped in area 184, where it will not be evacuated by the flow of coolant from the coolant inlet 144 to the coolant opening 164.

In accordance with various aspects of the present disclosure, the integrated deaeration chamber 98 in connection with the deaeration opening 168 accounts for the lower end 122 coolant opening and provides deaeration at the higher end 130 with one integrated chamber. In particular, the primary coolant opening 164 is sized and shaped to have an opening width or area to urge a majority of the coolant flow in heat exchange chamber 94 to counter-flow relative to the exhaust gas flow. In one exemplary implementation, a majority includes more than 50% and, in one particular implementation, more than 66% or 75%. Any vaporized coolant or air in heat exchange chamber 94 will accumulate at the highest point or area of the heat exchanger 18, namely area 184. The deaeration opening 168 is, in one exemplary implementation, positioned at the highest or substantially highest point (i.e., closest to or at end 130) of deaeration area 184 and is sized and shaped to allow a small amount or minority of the coolant to flow therethrough to carry or draw the air and/or gas through deaeration opening 168 and into deaeration chamber 98. In this implementation, the coolant in the deaeration chamber 98 entering through coolant opening 164 flows in the direction of arrow A from lower end 122 to and through the coolant exit 178 at upper end 130.

Figure 3:
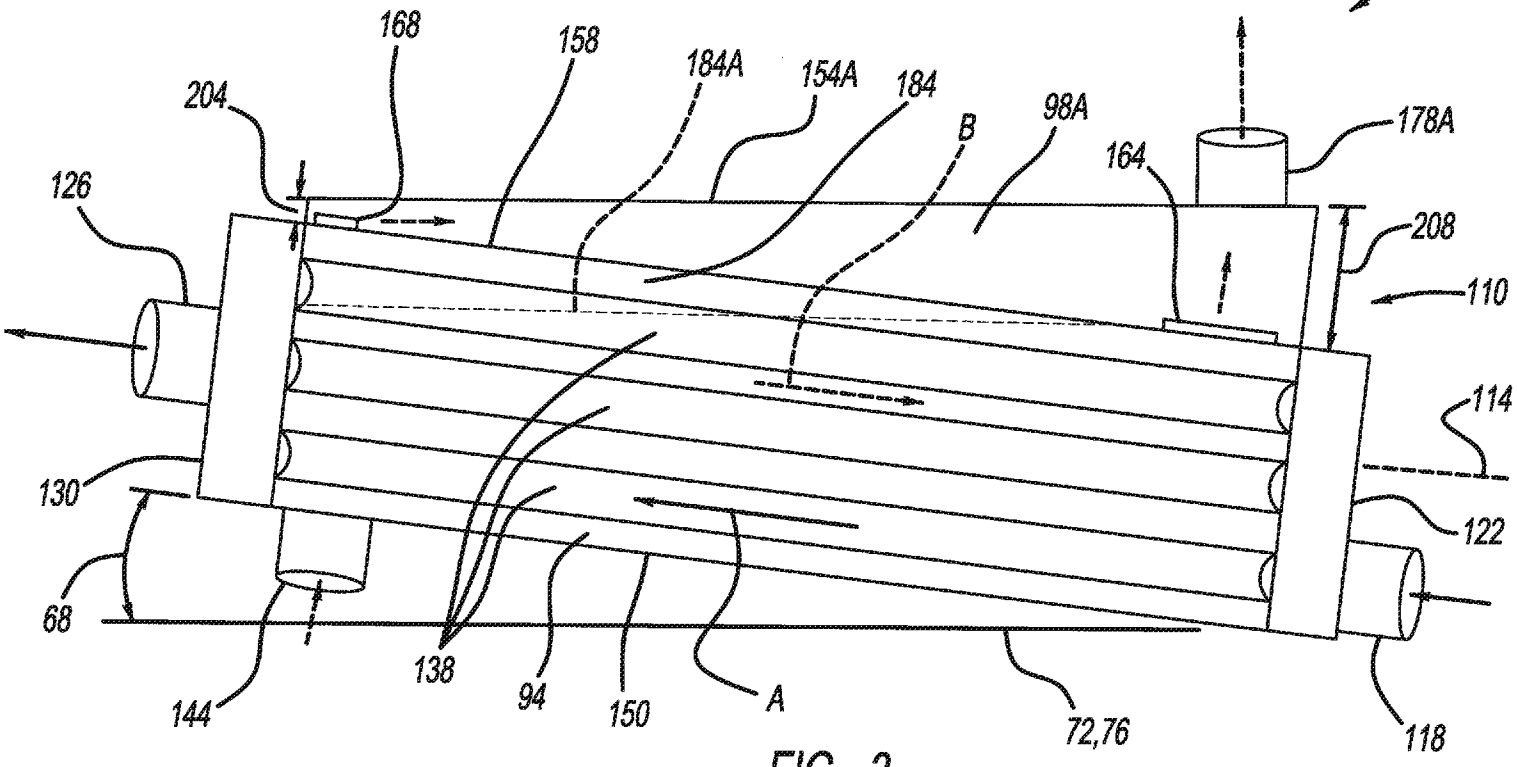
FIG. 3 is a schematic illustration of an exemplary implementation of the EGR heat exchanger with continuous deaeration according to the principles of the present disclosure.

Turning now to FIG. 3 and with reference back to FIGS. 1 and 2, another exemplary implementation of exhaust gas heat exchanger 18 is shown and will now be discussed, where like components or features with the implementation of heat exchanger 18 in FIG. 2 include the same reference numerals. The implementation of heat exchanger 18 shown in FIG. 3 includes similarities with the implementation shown in FIG. 2 such that only differences in features and operation will be discussed in detail.

In the exemplary implementation shown in FIG. 3, the deaeration chamber 98A includes the coolant outlet 178A at the first or lower end 122 together with the deaeration chamber 98A being configured such that the coolant outlet 178A at the lower end 122 is positioned at the highest or substantially highest point of chamber 98A. In the example illustrated, the deaeration chamber 98A includes a smaller or first height 204 at the second or upper end 130 and a second or larger height 208 at the first or lower end 122 such that the upper wall 154A of the deaeration chamber and/or top of housing 110 increases in distance from the chamber wall 158 as it extends from the upper end 130 to the lower end 122. Therefore, the coolant outlet 178A in upper wall 154A at the lower end 122 is at the highest or substantially highest point of deaeration chamber 98A.

As a result, gas/air in area 184 that flows through deaeration opening 168 will flow to the highest point of the deaeration chamber, namely the outlet 178A. In addition, the coolant flow through deaeration opening 168 together with the flow through coolant opening 164 and adjacent coolant outlet 178A will aid in drawing the evacuated air in chamber 98A proximate deaeration opening 168 toward and through coolant outlet 178A.

Figure 4:
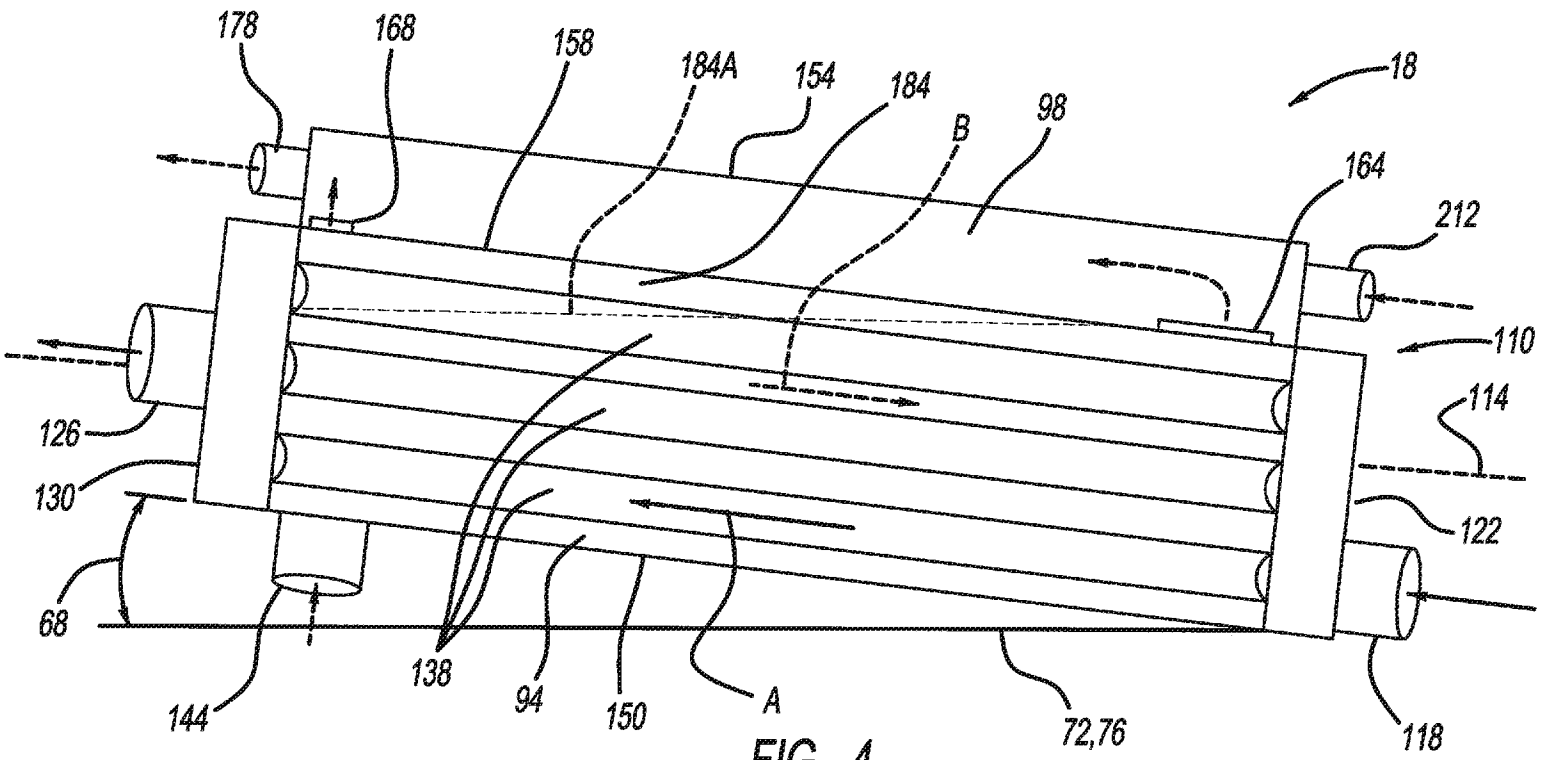
FIG. 4 is a schematic illustration of an exemplary implementation of the EGR heat exchanger with continuous deaeration according to the principles of the present disclosure.

Turning now to FIG. 4 with reference back to FIGS. 1 and 2, another exemplary implementation of exhaust gas heat exchanger 18 is shown and will now be discussed, where like components or features with the implementation of heat exchanger 18 in FIG. 2 also include the same reference numerals. The implementation of heat exchanger 18 shown in FIG. 4 likewise includes similarities with the implementation shown in FIG. 2 such that only differences in features and operation will be discussed in detail.

In the exemplary implementation shown in FIG. 4, the deaeration chamber 98 includes additional coolant flow or bypass flow into the deaeration chamber 98 at the lower end 122 via a by-pass inlet 212. Incorporating by-pass flow from the cooling circuit, such as from the heater core return line 104, can eliminate hose connections and reduce under hood space utilization thereby resulting in improved under hood packaging. In this exemplary implementation, the coolant exiting from coolant outlet 178 includes coolant from heat exchange chamber 94, evacuated air/gas from heat exchange chamber 94 and by-pass flow entering deaeration chamber 98 via by-pass inlet 212.

Figure 5:
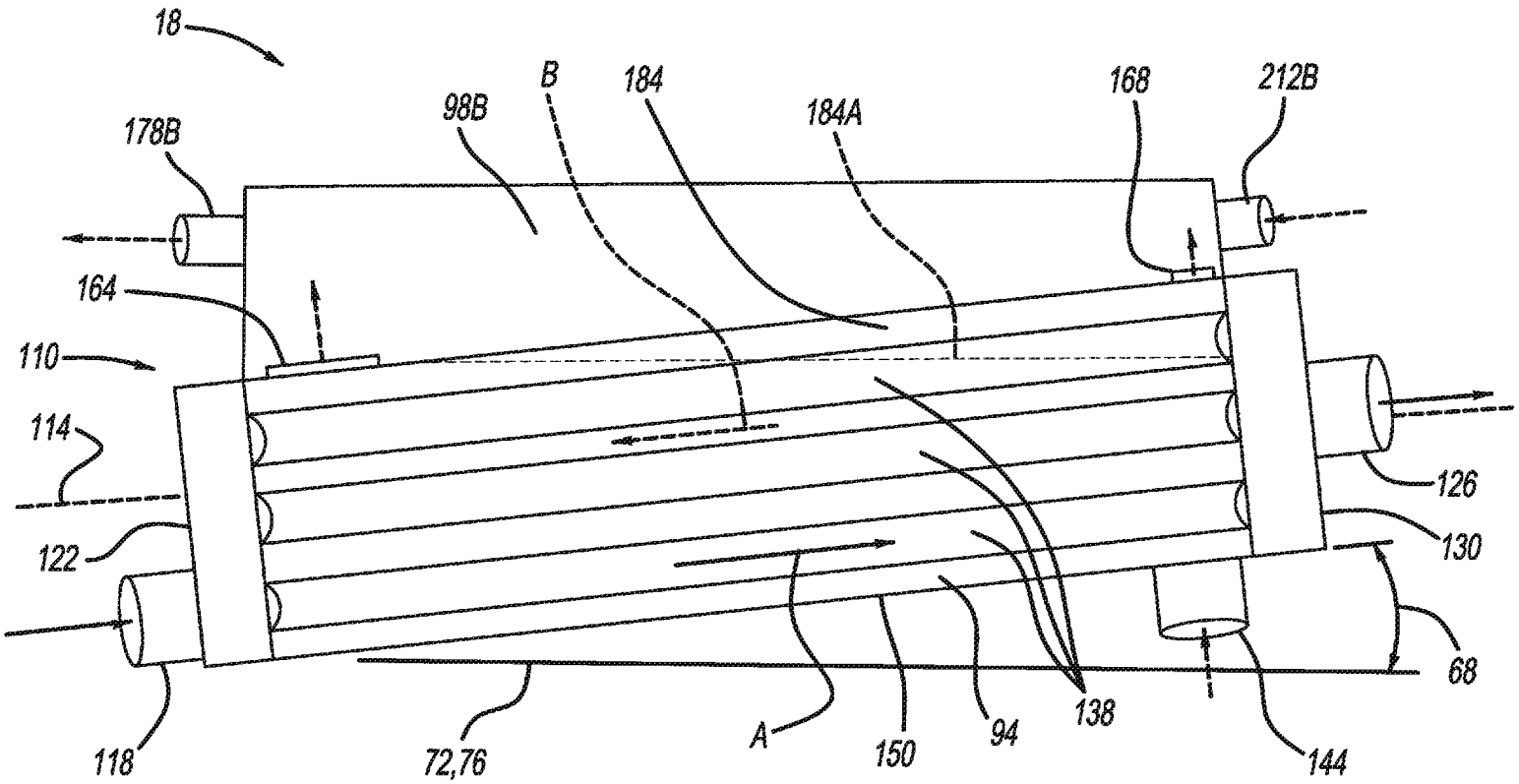
FIG. 5 is a schematic illustration of an exemplary implementation of the EGR heat exchanger with continuous deaeration according to the principles of the present disclosure.

Turning now to FIG. 5, and with reference back to FIGS. 1-4, another exemplary implementation of exhaust gas heat exchanger 18 is shown and will now be discussed, where like components or features with the implementation of heat exchanger 18 in FIGS. 2-4 similarly include the same reference numerals. The implementation of heat exchanger 18 shown in FIG. 5 includes similarities with at least the implementation shown in FIG. 3 such that only differences in features and operation will be discussed in detail.

In the exemplary implementation shown in FIG. 5, the deaeration chamber 98B is similar to the deaeration chamber 98A of FIG. 3 while also including or incorporating by-pass flow. In the particular example shown in FIG. 5, the deaeration chamber 98B includes a by-pass inlet 212B at or proximate the second end 130 where by-pass flow, such as from the heater core return line 104, enters deaeration chamber 98B and flows through chamber 98B toward and out coolant outlet 178B located at of proximate the first end 122. In this exemplary implementation, the by-pass coolant flow through deaeration chamber 98B is from the second end 130 to the first end 122 in the same or substantially the same direction as arrow A.

The exhaust gas heat exchanger 18 thus provides an integrated deaeration arrangement for a counter-flow EGR heat exchanger where the heat exchanger 18 is mounted at an incline relative to, for example, an exhaust manifold of an associated engine. The integrated deaeration arrangement provides for deaeration of the heat exchanger chamber within the packaging of the EGR heat exchanger housing providing an optimized EGR heat exchanger assembly with continuous deaeration that does not require additional coolant hose fittings. The EGR heat exchanger 18 with the integrated deaeration chamber is particularly advantageous when the coolant outlet is required to be on the low side of the inclined EGR heat exchanger so as to provide for adequate drainage of exhaust gas condensation while also providing a counter-flow cooling arrangement.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A heat exchanger for an exhaust gas recirculation system for an engine, the heat exchanger comprising:

an exhaust gas recirculation (EGR) heat exchange unit having a housing including an exhaust gas inlet end, an opposed exhaust gas outlet end, a bottom side, an opposed top side, and a chamber wall partitioning an internal volume of the heat exchange unit into a heat exchange chamber and a deaeration chamber;

the heat exchange chamber including a coolant inlet proximate the exhaust gas outlet end, a coolant opening in the chamber wall proximate the exhaust gas outlet end, an exhaust gas inlet at the exhaust gas inlet end, an exhaust gas outlet at the exhaust gas outlet end, a transfer passage coupling the exhaust gas inlet to the exhaust gas outlet, and a deaeration opening in the chamber wall proximate the exhaust gas outlet end, the deaeration chamber including a coolant outlet proximate the exhaust gas inlet end;

the heat exchange unit configured to cool exhaust gas flowing through the transfer passage with coolant flowing within the heat exchange chamber and around the transfer passage; and the heat exchange unit adapted to be mounted relative to the engine at an incline such that the deaeration opening is configured to evacuate gas from the heat exchange chamber to the deaeration chamber and the flow of coolant into the deaeration chamber from the heat exchange chamber via the coolant opening is configured to route the evacuated gas out of the deaeration chamber via the coolant outlet;

wherein the deaeration chamber includes an exhaust gas outlet end height smaller than an exhaust gas inlet end height such that the coolant outlet is positioned at substantially a highest area of the heat exchange unit relative to the bottom side.

2. The heat exchanger of claim 1, wherein the heat exchange unit is configured such that the coolant flows in a counter flow pattern from the exhaust gas outlet side to the exhaust gas inlet side.

3. The heat exchanger of claim 1, wherein the deaeration opening is sized and shaped to have a smaller opening area relative to the coolant opening whereby a majority of the coolant flowing in the heat exchange chamber exits through the coolant opening while a portion of the coolant exits through the deaeration opening to evacuate gas from the heat exchange chamber.

4. The heat exchanger of claim 3, wherein the heat exchange unit is adapted to be mounted at the incline relative to an exhaust manifold of the engine such that the deaeration opening is spaced apart from the exhaust manifold by a greater distance than the coolant opening.

5. A heat exchanger for an exhaust gas recirculation system for an engine, the heat exchanger comprising:

an exhaust gas recirculation (EGR) heat exchange unit having a housing including an exhaust gas inlet end, an opposed exhaust gas outlet end, a bottom side, an opposed top side, and a chamber wall partitioning an internal volume of the heat exchange unit into a heat exchange chamber and a deaeration chamber;

the heat exchange chamber including a coolant inlet proximate the exhaust gas outlet end, a coolant opening in the chamber wall proximate the exhaust gas outlet end, an exhaust gas inlet at the exhaust gas inlet end, an exhaust gas outlet at the exhaust gas outlet end, a transfer passage coupling the exhaust gas inlet to the exhaust gas outlet, and a deaeration opening in the chamber wall proximate the exhaust gas outlet end, the deaeration chamber including a coolant outlet proximate the exhaust gas inlet end;

the heat exchange unit configured to cool exhaust gas flowing through the transfer passage with coolant flowing within the heat exchange chamber and around the transfer passage; and the heat exchange unit adapted to be mounted relative to the engine at an incline such that the deaeration opening is configured to evacuate gas from the heat exchange chamber to the deaeration chamber and the flow of coolant into the deaeration chamber from the heat exchange chamber via the coolant opening is configured to route the evacuated gas out of the deaeration chamber via the coolant outlet;

wherein the deaeration chamber includes a bypass flow inlet adapted to receive coolant flow from the cooling circuit independent of the flow from the heat exchange chamber.

6. A vehicle, comprising:

an engine system including an engine, an intake manifold, an exhaust manifold, an exhaust gas recirculation (EGR) system fluidly coupled to the intake manifold and the exhaust manifold, and a cooling circuit fluidly coupled to the engine and the EGR system;

a heat exchanger for the EGR system, including:

a housing forming a heat exchange chamber and a separate deaeration chamber in fluid communication with the heat exchange chamber, the housing including an exhaust gas inlet end, an opposed exhaust gas outlet end a bottom side, an opposed top side, and a chamber wall within the housing partitioning an internal volume of the housing into the heat exchange chamber and the deaeration chamber;

the heat exchange chamber including a coolant inlet proximate the exhaust gas outlet end, a coolant opening in the chamber wall proximate the exhaust gas inlet end, an exhaust gas inlet at the exhaust gas inlet end, an exhaust gas outlet at the exhaust gas outlet end, a transfer passage coupling the exhaust gas inlet and outlet, and a deaeration opening in the chamber wall proximate the exhaust gas outlet end, the deaeration chamber including a coolant outlet proximate the exhaust gas inlet end;

the heat exchange unit configured to cool exhaust gas from the exhaust manifold flowing through the transfer passage with coolant from the cooling circuit flowing into the heat exchange chamber via the coolant inlet and around the transfer passage;

wherein the heat exchanger is configured to be mounted relative to the engine at an incline such that the deaeration opening is configured to evacuate gas from the heat exchange chamber to the deaeration chamber, and the flow of coolant into the deaeration chamber from the heat exchange chamber via the coolant opening is configured to route the evacuated gas out of the deaeration chamber via the coolant outlet to the cooling circuit;

wherein the deaeration chamber includes an exhaust gas outlet end height smaller than an exhaust gas inlet end height such that the coolant outlet is positioned at substantially a highest area of the deaeration chamber relative to the bottom side of the heat exchanger and the exhaust manifold.

7. The vehicle of claim 6, wherein the heat exchange unit is configured such that the coolant flows in a counter flow pattern from the exhaust gas outlet end to the exhaust gas inlet end.

8. The vehicle of claim 7, wherein the deaeration opening is spaced apart a greater distance from the exhaust manifold than the coolant opening.

9. The vehicle of claim 6, wherein the deaeration opening is sized and shaped to have a smaller opening area relative to the coolant opening whereby a majority of the coolant flowing in the heat exchange chamber exits through the coolant opening while a portion of the coolant exits through the deaeration opening to evacuate gas from the heat exchange chamber.

10. The vehicle of claim 6, wherein the coolant flows in the heat exchange chamber from the exhaust gas outlet end to the exhaust gas inlet end and flows from the coolant opening at the exhaust gas inlet end to the coolant outlet at the exhaust gas inlet end thereby drawing coolant through the deaeration opening and though the deaeration chamber in the same direction as the coolant flows through the heat exchange chamber.

11. The vehicle of claim 6, further comprising a bypass flow inlet fluidly coupled to the deaeration chamber and configured to receive coolant flow from the cooling circuit independent of the flow from the heat exchange chamber to aid in evacuation of gas and coolant from the deaeration chamber back to the cooling circuit.

* * * * *